US007988468B2

(12) United States Patent
Yang et al.

(10) Patent No.: US 7,988,468 B2
(45) Date of Patent: Aug. 2, 2011

(54) PROTECTIVE COVER MECHANISM AND PORTABLE ELECTRONIC DEVICE USING SAME

(75) Inventors: Mu-Wen Yang, Taipei Hsien (TW); Chih-Chiang Chang, Taipei Hsien (TW); Zheng Shi, Shenzhen (CN)

(73) Assignees: Shenzen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 265 days.

(21) Appl. No.: 12/464,195

(22) Filed: May 12, 2009

(65) Prior Publication Data

US 2009/0284906 A1 Nov. 19, 2009

(30) Foreign Application Priority Data

May 16, 2008 (CN) ..... 2008 1 0301612

(51) Int. Cl.
*H01R 13/44* (2006.01)

(52) U.S. Cl. ..... 439/136; 439/135

(58) Field of Classification Search ..... 439/135–138
See application file for complete search history.

(56) References Cited

U.S. PATENT DOCUMENTS

| | | | | |
|---|---|---|---|---|
| 6,612,853 | B2 * | 9/2003 | Wu | 439/136 |
| 6,652,297 | B1 * | 11/2003 | Zhang et al. | 439/136 |
| 2004/0203270 | A1 * | 10/2004 | Wang | 439/136 |
| 2008/0026614 | A1 * | 1/2008 | Emerson et al. | 439/136 |
| 2009/0258516 | A1 * | 10/2009 | Hiew et al. | 439/136 |

FOREIGN PATENT DOCUMENTS

CN 2674787 Y 1/2005

* cited by examiner

*Primary Examiner* — Hien Vu
(74) *Attorney, Agent, or Firm* — Steven M. Reiss

(57) ABSTRACT

A protective cover mechanism for an interface opening of a portable electronic device includes a protective cover and a sliding member. The protective cover includes a cover body for covering the interface opening, and a shaft projecting from the cover body. The sliding member is engaged with the shaft of the protective cover so the cover body is rotatable relative to the sliding member to selectively cover or expose the interface opening.

11 Claims, 6 Drawing Sheets

PROTECTIVE COVER MECHANISM AND PORTABLE ELECTRONIC DEVICE USING SAME

BACKGROUND

1. Technical Field

The exemplary invention relates to protective cover mechanisms and, particularly to cover mechanisms for protecting interface openings of electronic devices and portable electronic devices using the protective cover mechanism.

2. Description of the Related Art

Modern electronic devices, such as wireless telephone units, allow users to place a phone call and exchange data from virtually any location within the service area. Wireless telephone units typically incorporate a rechargeable battery pack so the device can be completely mobile. However, these battery packs must be periodically connected to a power source to be recharged. An external interface opening is usually provided on the device for connecting the battery or battery pack to an external power source. Additionally, an external interface opening, e.g., USB, might be provided on a wireless telephone to allow the phone to be connected to other electronic devices for transmitting and receiving data.

Wireless telephones are not the only modern electronic devices which can be connected to other devices to increase functionality. For example, even smaller computers such as palmtop or electronic notepad computers can be connected to larger computer systems, modems or printers to provide additional functions.

In all these examples, an electronic device needs an external port, interface opening or connector for easy connection to other electronic devices, accessories or networks. However, external interface openings must be protected from the external environment to function properly.

To protect external interface openings, ports and connectors on an electronic device, it is common to provide a cover that can, for example, be snapped or slid into place over the interface opening. However, after the covers are removed from the electronic device to access the interface opening, it is very easy to misplace and lose the cover.

Therefore, there is a room for improvement within the art.

BRIEF DESCRIPTION OF THE DRAWINGS

Many aspects of the exemplary protective cover mechanism and portable electronic device can be better understood with reference to the following drawings. These drawings are not necessarily drawn to scale, the emphasis instead being placed upon clearly illustrating the principles of the exemplary protective cover mechanism and portable electronic device. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE PREFERRED EMBODIMENT

The present protective cover mechanism is suitably assembled within a portable electronic device, such as a mobile phone, a personal digital handset, or the like.

Figure 1:
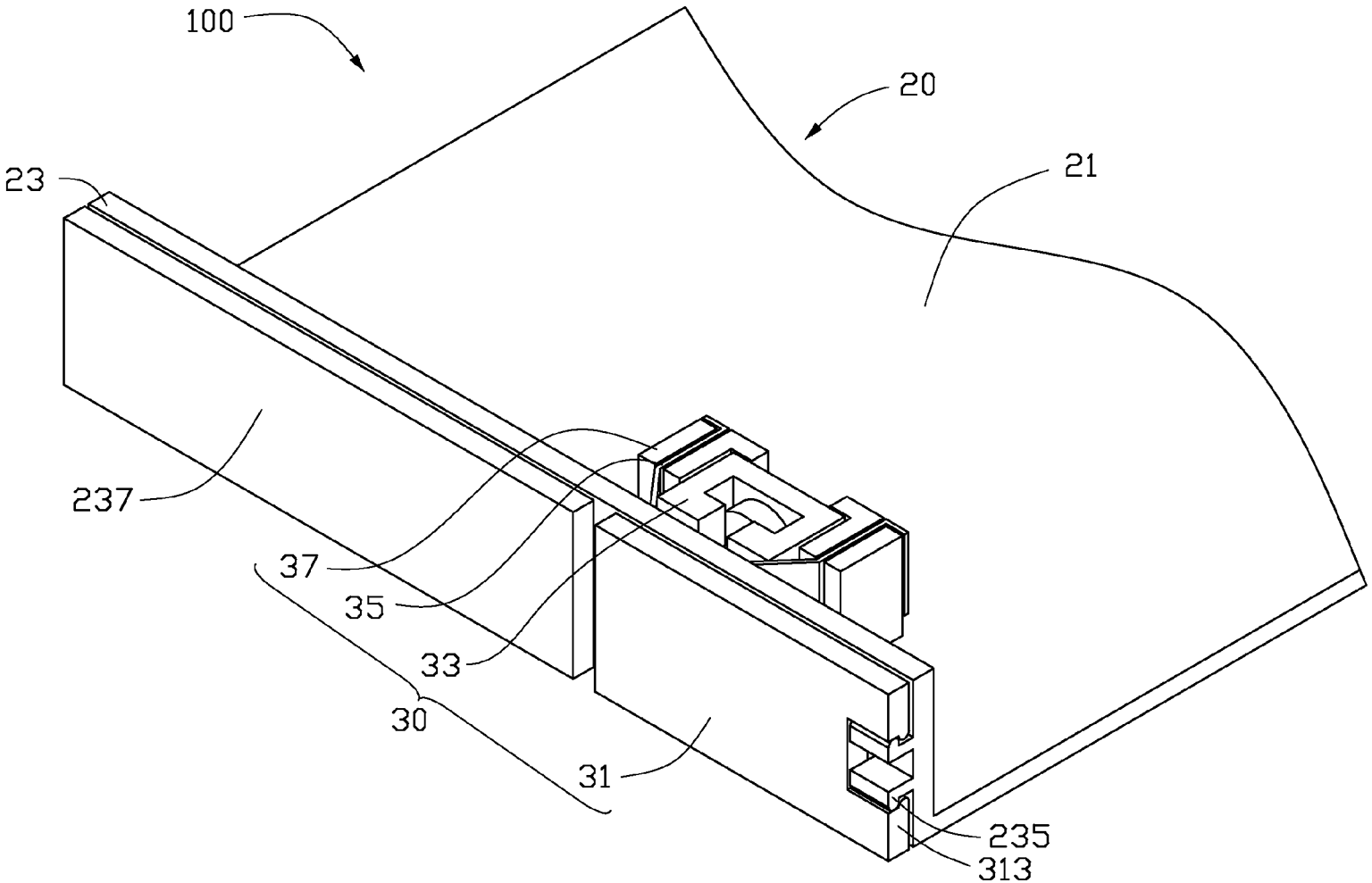
FIG. 1 is a schematic, assembled view of a protective cover mechanism equipped to a portable electronic device according to a present embodiment.
Figure 2:
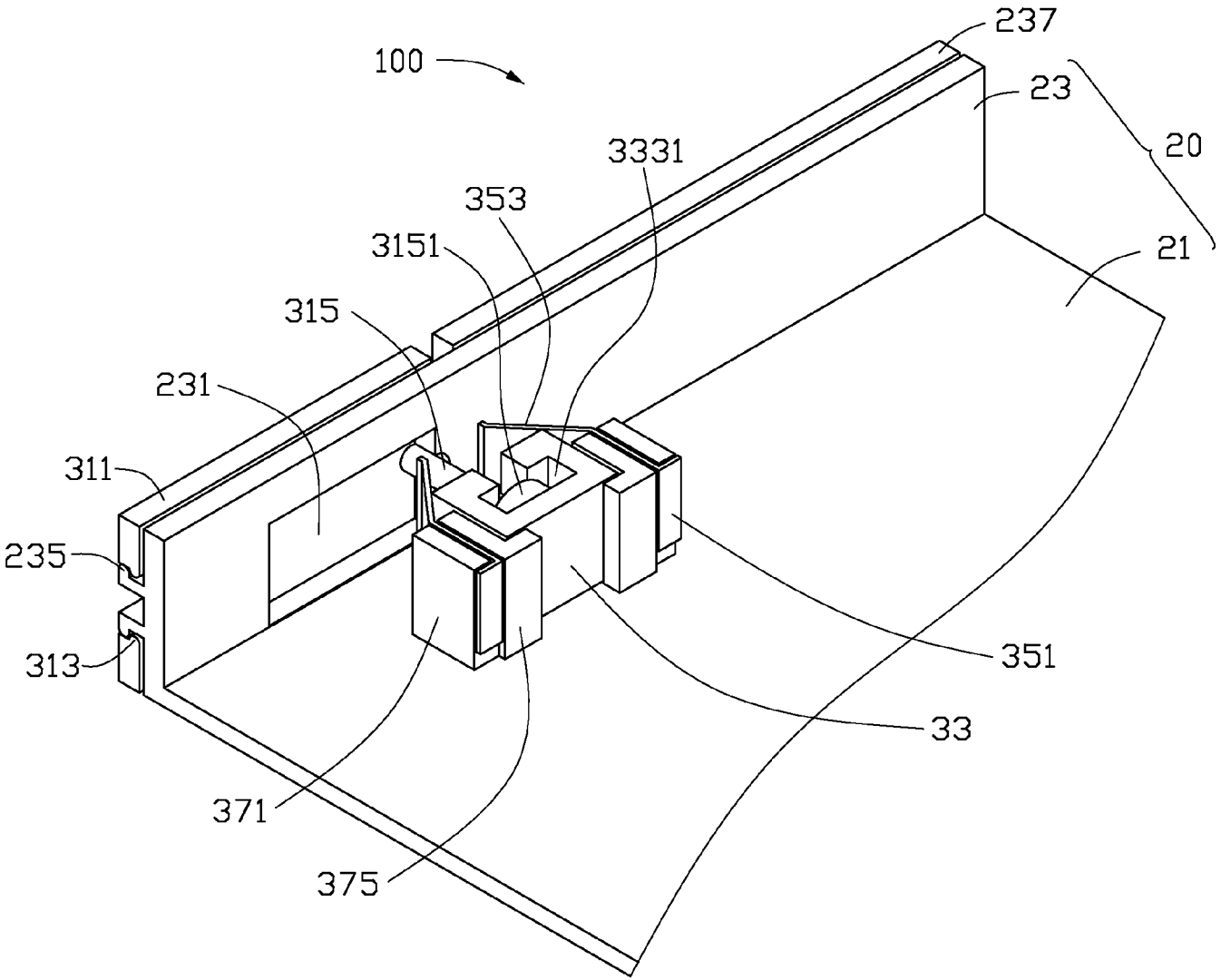
FIG. 2 is similar to FIG. 1, but viewed from another aspect.
Figure 3:
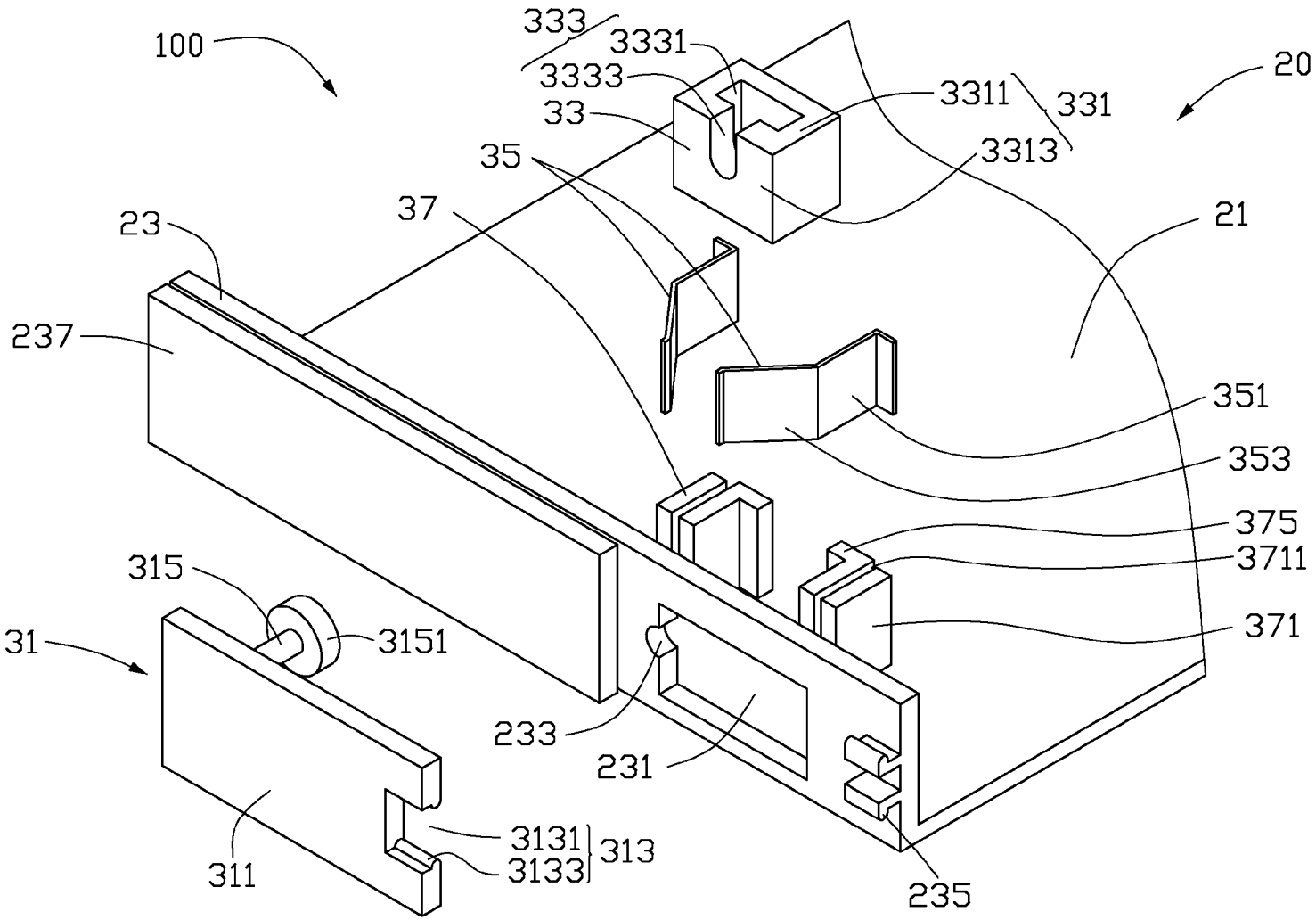
FIG. 3 is a disassembled schematic view of the protective cover mechanism of FIG. 1.
Figure 4:
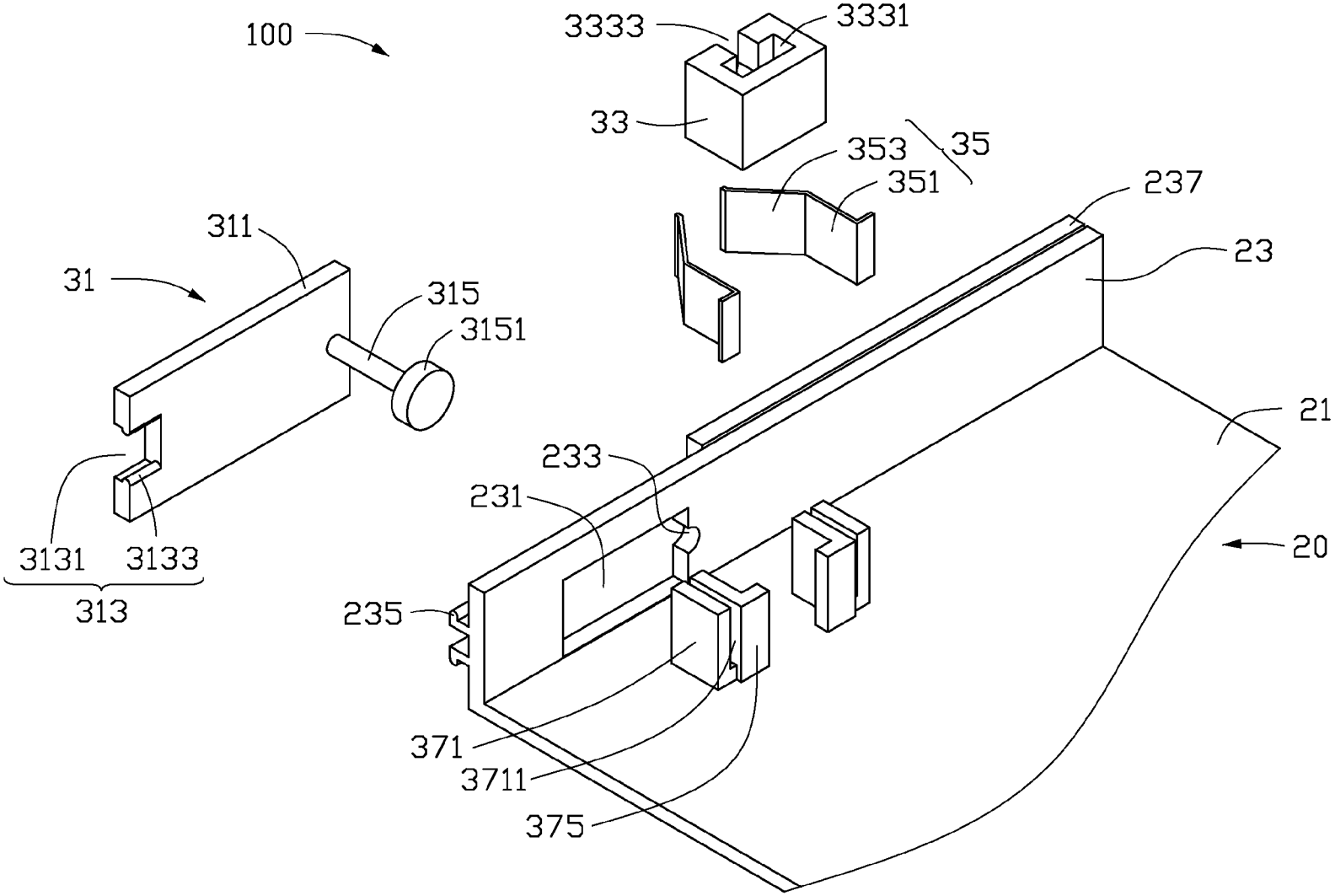
FIG. 4 is a disassembled schematic view of the protective cover mechanism of FIG. 2.

Referring to FIGS. 1 and 2, an exemplary protective cover mechanism 30 is equipped on a housing 20 of a portable electronic device 100 for covering and protecting an interface opening 231. The housing 20 can be one of a top cover or a back cover of the portable electronic device 100, and configured for receiving electronic components therein. The housing 20 includes a base wall 21 and a side wall 23 mounted on the base wall 21. The base wall 21 is configured to accommodate electronic components, e.g., a USB connector, and mechanical components, e.g., portions of the protective cover mechanism 30, mounted thereon. Also referring to FIGS. 3 and 4, the side wall 23 includes an interface opening 231, a hole 233, a fastening portion 235, and a supporting member 237. The interface opening 231 is configured for exposing a connector, e.g., the USB connector, to ambient environment, and is an opening defined through the side wall 23. The hole 233 is defined through the side wall 23, adjacent to the interface opening 231, and is preferably to communicate with the interface opening 231 as shown in the exemplary embodiment. The fastening portion 235 and the supporting member 237 both are disposed on an outer surface of the side wall 23, at opposite sides of the interface opening 231. The fastening portion 235 is disposed opposite to the hole 233, and includes two L-shaped hooks projecting from the side wall 23. The two hooks are disposed back to back. The supporting member 237 can be a rectangular board, and attached to the side wall 23, adjacent to the hole 233.

The protective cover mechanism 30 includes a protective cover 31, a sliding member 33, an elastic member 35, and a fixture 37. The protective cover 31 is engaged with the sliding member 33 to be rotatable relative to and slidable with the sliding member 33. The sliding member 33 is mounted between the elastic member 33 and the fixture 37, and can slide with the protective cover 31 and return to an initial position under elastic force of the elastic member 33.

The protective cover 31 is made from flexible material, such as plastic or rubber, and is rotatably mounted to the housing 20 to selectively cover the interface opening 231 or expose the interface opening 231 to ambient environment. The protective cover 31 includes a cover body 311, a locking portion 313 and a shaft 315. The cover body 311 is sized and shaped to cover and protect the interface opening 231 of the housing 20, and is preferably a rectangular board member having a size larger than that of the interface opening 231. The locking portion 313 and the shaft 315 are formed on opposite ends of the cover body 311. The locking portion 313 is configured for detachably engaging with the latching portion 235 of the housing 20, and has a cutout 3131 defined at an end of the cover body 311 thereby forming two opposite surfaces inside the cutout 3131. The locking portion 313 further includes two blocks 3133 projecting respectively from the opposite surfaces into the cutout 3131. The cutout 3131 can receive the hooks of the latching member 235 therein, with the blocks 3133 engaging with the hooks. The shaft 315 can be integrally formed with the cover body 311, and projects from an inner surface of the cover body 311, adjacent to the other end of the cover body 311. The shaft 315 has a projection 3151 formed at a distal end thereof.

The sliding member 33 includes a base 331, and a cavity 333 defined in the base 331. The base 331 may have a top surface 3311, and a side surface 3313 connecting with the top surface 3311. The cavity 333 is T-shaped, and includes a recess 3331 and a groove 3333. The recess 3331 is recessed in the top surface 3311, and is sized and shaped to fittingly receiving the projection 3151 of the shaft 315. The groove 3333 is recessed in the side surface 3313 and penetrates the top surface 3311. The groove 3333 is configured for receiving the shaft 315 therein, and communicates with the recess 3331.

The elastic member 35 includes two elastic sheets. Each elastic sheet includes a fixed segment 351, and a deforming segment 353. The fixed segment 351 is L-shaped, and secures the elastic member 35 to the fixture 37. The deforming segment 353 is inclined and connected with the fixed segment 351. The two elastic sheets are positioned face to face in a way that two distal ends thereof are closer than the other two ends thereof which connect with the fixed segments 351.

The fixture 37 is configured for slidably receiving the sliding member 33 therein, and securing the elastic member 35 thereto. The fixture 37 includes two base bodies 371 mounted on the base wall 21 of the housing 20. The two base bodies 371 are spaced from the side wall 32, on opposite sides of the hole 233. Each base body 371 includes a gap 3711 defined therethrough and a bottom 375 formed thereon. The gaps 3711 are configured to respectively receiving a fixed segment 353 therein. The two bottom 375 are respectively projected from an end of a base body 371, and are disposed away from the side wall 23. The two base bodies 371 are positioned face to face in a way that the two bottoms 375 extend towards each other.

In assembly, first, the two elastic sheets of the elastic member 35 are respectively engaged with the two base bodies 371. The fixed segments 351 of the elastic member 35 are accommodated in the gaps 3711 and locked by base bodies 371. The deforming segments 353 are disposed between the side wall 23 and the base bodies 371, the distal ends of the deforming segments 383 resists against the side wall 23. The elastic member 35 and the fixture 37 cooperatively form a receiving space therebetween for receiving the sliding member 33. Then, the sliding member 33 is placed into the receiving space, between the two base bodies 371 of the fixture 37. Two opposite ends of the sliding member 33 respectively resists against the bottoms 375 of the two base bodies 371 and the deforming segments 353 of the elastic member 35. The groove 3333 of the sliding member 33 is positioned adjacent to the side wall 23. Finally, the protective cover 31 is rotatably mounted to the sliding member 33. The shaft 315 is inserted through the interface opening 231, received into the hole 233 and resists against a distal end of the deforming segment 353. The projection 3151 of the shaft 315 is received in the recess 3331. The locking portion 313 engages with the latching portion 235 of the side wall 23, so that the cover body 311 is attached to the side wall 233 and covers the interface opening 231.

Figure 5:
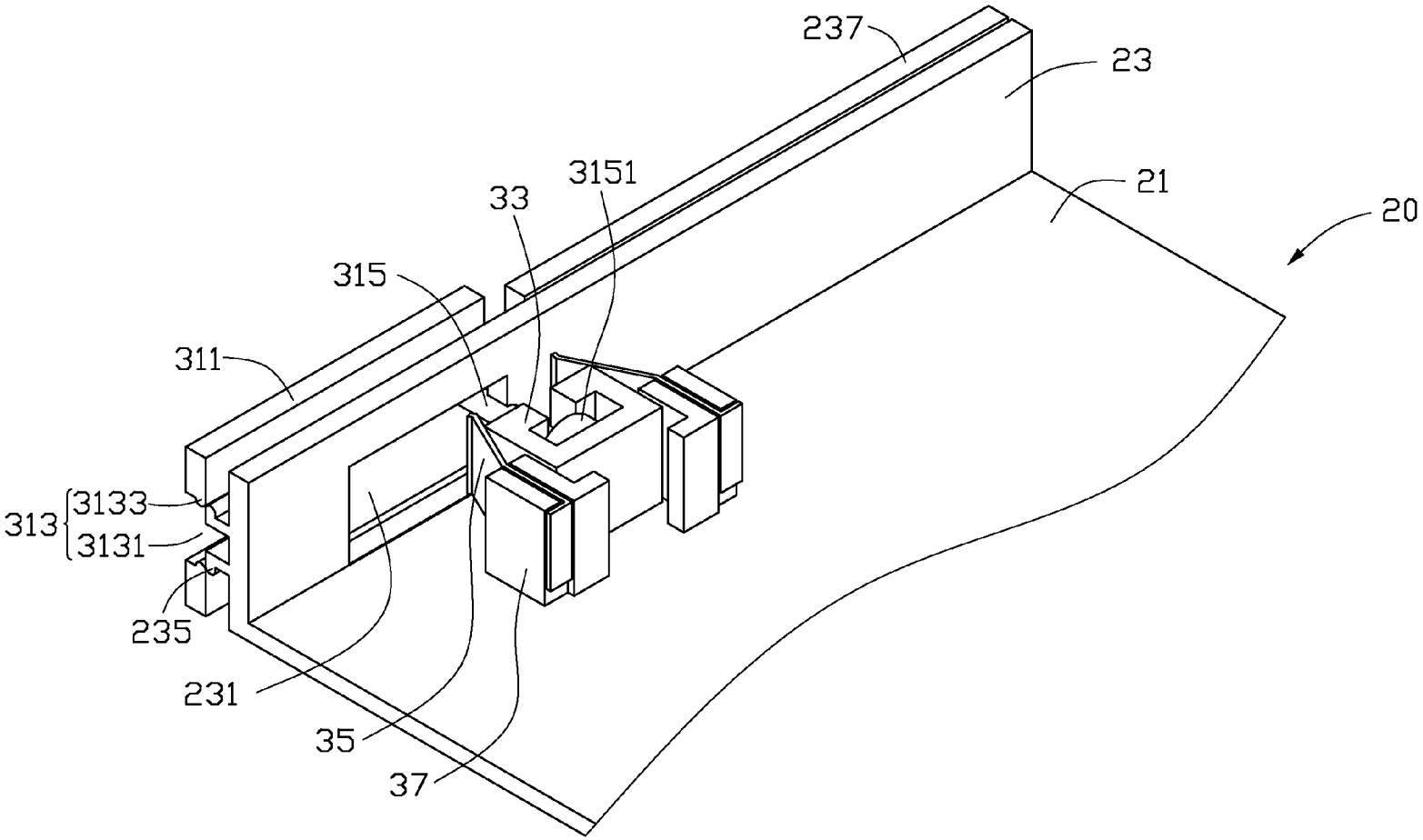
FIG. 5 shows the protective cover mechanism of FIG. 2 in a status that a protective cover is unlocked.
Figure 6:
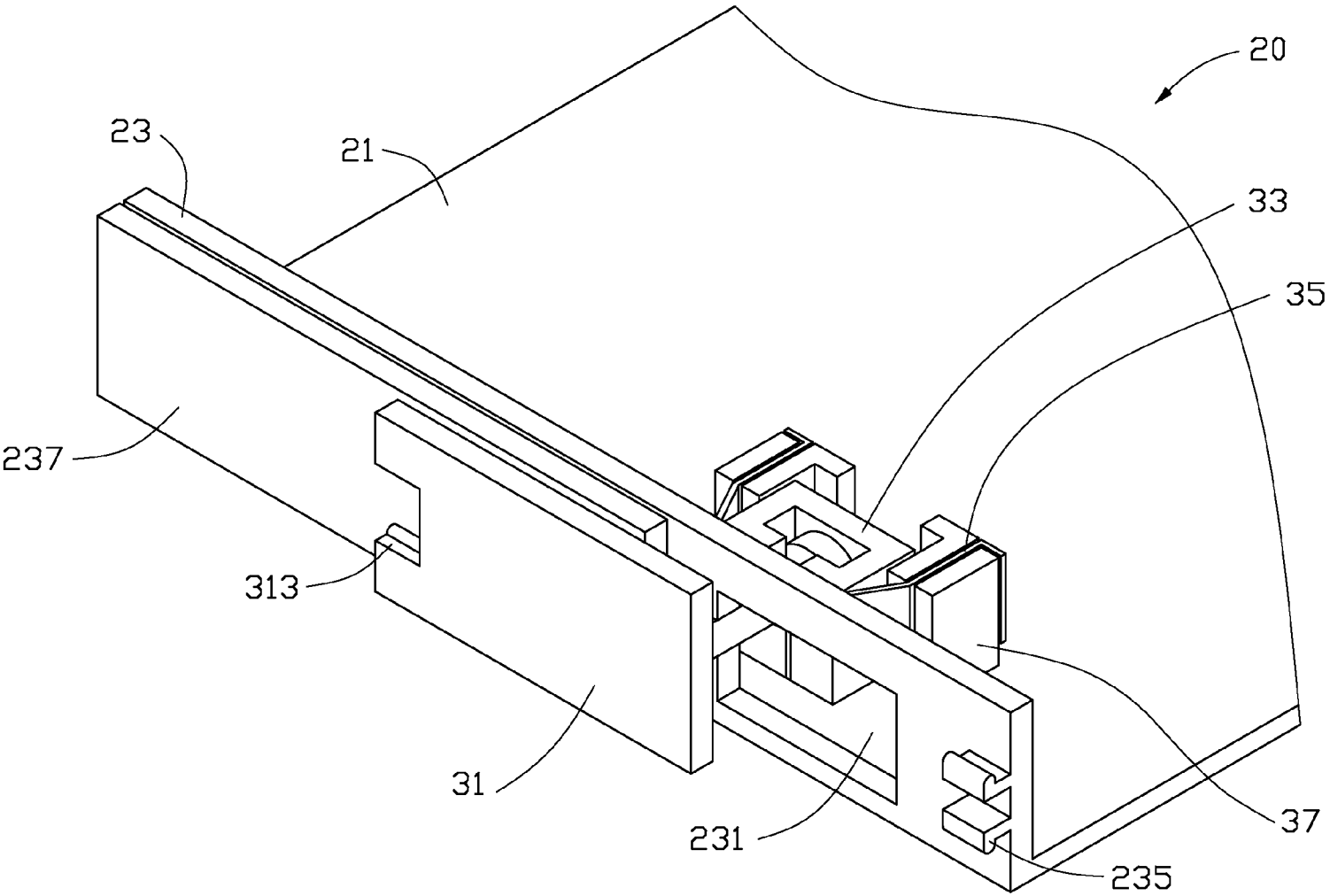
FIG. 6 shows the protective cover mechanism of FIG. 1 in a status that an interface opening being exposed.

Referring to FIGS. 5 and 6, in use, when the interface opening 231 needs to be accessed, the protective cover 31 can be opened to expose the interface opening 231. The protective cover 31 is pulled by external force of a user so that the locking portion 313 is unlocked from the latching portion 235. Jointly, the sliding member 33 is pulled to move towards the side wall 23 by the shaft 315 of the protective cover 31, and the two deforming segments 353 of the elastic member 35 are bent outwards by the sliding member 33. Then, the protective cover 31 is rotated 180 degrees to expose the interface opening 231. When access to the interface opening 231 is not needed, the protective cover 31 is returned to cover the interface opening 231. Firstly, the protective cover 31 is rotated in 180 degrees to face to the interface opening 231, and then is released by the user. The deforming segments 353 rebounds and drives the sliding member 33 slide towards the bottom 375 of the base bodies 371. Jointly, the shaft 315 moves together with the sliding member 33 until the cover body 311 attaches to the side wall 23 and the locking portion 313 is locked by the latching portion 235 of the side wall 23.

In the present invention, the protective cover 31 is connected to the housing 20 in the whole using process. Thus, the protective cover 31 is in low risk of being dropped by users.

It is to be understood, however, that even though numerous characteristics and advantages of the exemplary invention have been set forth in the foregoing description, together with details of the structure and function of the exemplary invention, the disclosure is illustrative only, and changes may be made in detail, especially in matters of shape, size, and arrangement of parts within the principles of exemplary invention to the full extent indicated by the broad general meaning of the terms in which the appended claims are expressed.

What is claimed is:

1. A protective cover mechanism of a portable electronic device for covering an interface opening of the portable electronic device, comprising:

a protective cover comprising a cover body for covering the interface opening, and a shaft projecting outwardly from the cover body;

a sliding member engaged with the shaft of the protective cover so the cover body is rotatable relative to the sliding member to selectively cover or expose the interface opening;

wherein the fixture includes two base bodies spaced from each other, and the sliding member slidably mounted between the two base bodies;

wherein the sliding member has a cavity defined therein to rotatably receive the shaft; and wherein the shaft has a projection formed at an end thereof, and the cavity has a recess in the sliding member and a groove in a side surface of the sliding member for respectively receiving the projection and the shaft.

2. The protective cover mechanism as claimed in claim 1 further comprising an elastic member, wherein the elastic member is mounted to the fixture, and resists against the sliding member to drive the sliding member to slide.

3. The protective cover mechanism as claimed in claim 2, wherein each base body comprises a gap defined therein to receive the elastic member, and a bottom for resisting the sliding member.

4. The protective cover mechanism as claimed in claim 3, wherein the bottoms each project from an end of the base bodies and extend towards each other.

5. The protective cover mechanism as claimed in claim 3, wherein the elastic member comprises two elastic sheets, each elastic sheet comprises a fixed segment engaged in a gap, and a deforming segment inclined to the fixed segment.

6. The protective cover mechanism as claimed in claim 5, wherein the deforming segments resist against the sliding member to enclose the sliding member between the fixture and the elastic member.

7. The protective cover mechanism as claimed in claim 1, wherein the protective cover further includes a locking portion for detachably locking the cover body to the portable electronic device.

8. A portable electronic device, comprising:

a housing comprising a base wall, a side wall mounted to the base wall, and an interface opening defined in the side wall;

a protective cover mechanism for protecting the interface opening, comprising:

a protective cover comprising a cover body for covering the interface opening, and a shaft projecting outwardly from the cover body;

a sliding member mounted to the base wall, and engaged with the shaft of the protective cover so the cover body is rotatable relative to the sliding member to selectively cover or expose the interface opening;

wherein the protective cover mechanism further comprises a fixture mounted to the base wall, the fixture includes two base bodies spaced from each other, and the sliding member is slidably mounted to the base wall, between the two base bodies;

wherein the sliding member has a cavity defined therein to rotatably receive the shaft; and wherein the shaft has a projection formed at an end thereof, and the cavity has a recess in the sliding member and a groove in a side surface of the sliding member for respectively receiving the projection and the shaft.

9. The portable electronic device as claimed in claim 8, wherein the side wall further defines a hole therein for receiving the shaft, the hole communicates with the interface opening.

10. The portable electronic device as claimed in claim 8, wherein the side wall further comprises a supporting member attached thereon, the supporting member is disposed adjacent to the shaft so that when the protective cover is rotated to expose the interface opening, the protective cover can resist against the supporting member.

11. The portable electronic device as claimed in claim 8, wherein the side wall further comprises a latching portion, the cover body further comprises a locking portion disposed opposite to the shaft for detachably engaging with the latching portion.

* * * * *